US005225017A

United States Patent [19]

Ni

[11] Patent Number: 5,225,017

[45] Date of Patent: Jul. 6, 1993

[54] METHOD FOR FORMING A COVER OF AN UMBRELLA

[76] Inventor: Fong-Ming Ni, No. 2-5, Alley 16, Lane 337, Da-Tong Road, Section 1, Hsi-Chih, Taipei, Taiwan

[21] Appl. No.: 836,803

[22] Filed: Feb. 19, 1992

[51] Int. Cl.[5] ..... A45B 25/18

[52] U.S. Cl. ..... 156/163; 156/160; 156/229; 264/291; 135/33.2

[58] Field of Search ..... 135/33.2, 907; 156/163, 156/229, 245, 160; 264/291, 292, 327, 258, 231, 229

[56] References Cited

U.S. PATENT DOCUMENTS

| | | | |
|---|---|---|---|
| 792,737 | 6/1905 | Smith | 135/33.2 |
| 2,039,987 | 5/1936 | Goldman | 135/33.2 |
| 2,341,399 | 2/1944 | Timblin | 135/33.2 |
| 2,534,831 | 12/1950 | Polan | 135/33.2 X |
| 5,020,559 | 6/1991 | Lai | 135/33.2 |

FOREIGN PATENT DOCUMENTS

| | | | |
|---|---|---|---|
| 36918 | 10/1981 | European Pat. Off. | 135/33.2 |
| 55-11324 | 3/1980 | Japan | 135/33.2 |
| 73144261 | 11/1984 | Taiwan . | |
| 75208205 | 6/1989 | Taiwan . | |
| 75208205 | 2/1991 | Taiwan . | |
| 79204436 | 6/1991 | Taiwan . | |

*Primary Examiner*—Jeff H. Aftergut
*Attorney, Agent, or Firm*—Bacon & Thomas

[57] ABSTRACT

A method for forming a cover of an umbrella including preparing several pieces of cloth, clamping the perimeters of the cloth and pulling the cloth downward against a lower mold having a convex shape, heating the lower mold in order to soften the cloth, moving an upper mold downward to clamp the cloth, heating the lower mold again in order to further increase the temperature of the lower mold so that the cloth can be hot-pressed, cooling the lower mold, removing the cloth, and cutting the perimeter of the cloth so as to form the cover of the umbrella.

7 Claims, 5 Drawing Sheets

METHOD FOR FORMING A COVER OF AN UMBRELLA

BACKGROUND OF THE INVENTION

1. Field of the Invention:

The present invention relates to a method, and more particularly to a method for forming a cover of an umbrella.

2. Description of the Prior Art:

As shown in FIGS. 7, 8 and 9, the cover 14 of the umbrella comprises a plurality of triangular pieces 13 which are cut from a piece of cloth 11 and which are stitched or sewed together at lines 15 so as to form the cover 14. Because the pieces 13 are cut from the cloth 11, a pattern and the like should be formed or printed on the cover 14 of the umbrella after the pieces 13 are stitched together. This is inconvenient.

The present invention has arisen to mitigate and/or obviate the afore-described disadvantages of the conventional methods for forming the cover of the umbrella.

SUMMARY OF THE INVENTION

The primary objective of the present invention is to provide a method for forming the cover of an umbrella in which the cover is formed from at least one integral piece of cloth and the like and need not be cut before it is formed.

In accordance with one aspect of the present invention, there is provided a method for forming a cover of an umbrella comprising: preparing at least two pieces of cloth made of synthetic fibers and each having a plain weave configuration including two sets of fibers perpendicular with each other, each of the pieces of cloth including a perimeter; watering the cloth; applying waterproof glue on the cloth; fixing the perimeters of the two layers of cloth together; clamping the perimeters of the cloth by a clamping device, the clamping device including a lower member which is disposed on a first cylinder so that the lower member is movable up and down by the first cylinder, and an upper member disposed on a second cylinder which is disposed on the lower member so that the upper member is movable up and down by the second cylinder, the perimeters of the cloth being clamped by the upper member and the lower member when the upper member moves toward the lower member; preparing a lower mold and an upper mold, the lower mold having a convex shaped outer surface and including a hollow interior having an outlet and an inlet formed therein, the upper mold having a concave shaped surface and movable downward toward the lower mold for engagement with the convex shaped outer surface of the lower mold; moving the cloth to a position located above the lower mold; pulling the cloth downward against the lower mold by the first cylinder when the lower member is caused to move toward the lower mold; supplying heated steam into the lower mold so as to heat the lower mold in order to soften the cloth; moving the upper mold downward to clamp the cloth between the upper mold and the lower mold; supplying heated steam into the lower mold in order to further heat the lower mold so as to further increase the temperature of the lower mold so that the cloth is hot-pressed, the plain weave configuration of the cloth including a molecular structure which is loosened and rearranged when the cloth is hot-pressed, and the cloth being stretched such that the fibers are not perpendicular with each other; supplying cold water into the lower mold in order to cool the lower mold, the cloth being cooled such that the molecular structure of the plain weave configuration of the cloth having a fixed configuration and such that the cloth having an equilibrium strength; removing the cloth and cutting the perimeter of the cloth so as to form the cover of the umbrella which is bowl shaped; and hemming a perimeter of the cover so that the cover is formed.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENTS

Figure 1:
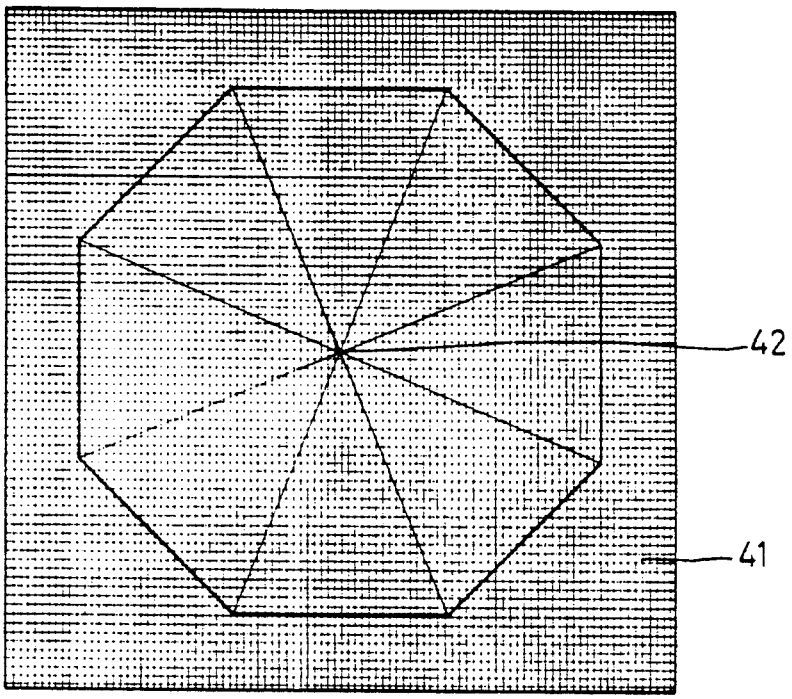
FIG. 1 is a plane view of a cloth for forming a cover of an umbrella.
Figure 2:
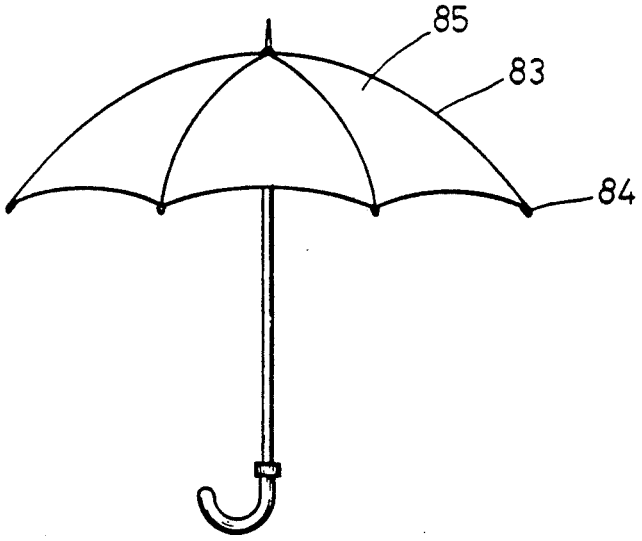
FIG. 2 is a front view of an umbrella.

Referring to the drawings and initially to FIGS. 1 and 2, a method for forming a cover of an umbrella in accordance with the present invention is provided to form a cover 85 of an umbrella from a plurality layers of cloth 41 having a center punctured with a hole 42, in which no stitches are required. In the example which will be illustrated hereinafter, it is preferable that at least five layers of cloth 41 are used for forming the cover 85. The umbrella comprises a plurality of staves 83 for supporting the cover 85 and ended at beads 84. The cover 85 is made of water proof materials, such as synthetic fiber (NYLON), or polyester (TETRON, DACRON), or Acrylic (ORLON), and preferably made of polyester materials. The weaving for forming the cover 85 is the so-called "plain weave" including two sets of threads or fibers perpendicular with each other. The plain weave weaving includes two types of organization, in which one is equilibrium organization, and the other is unequilibrium organization. The cloth 41 which is made of water-proof materials is dyed before a pattern is printed on the cloth 41. Before the cloth is cut to form the cover 85, a process for making the cover a water resistant cover is operated.

The cloth 41 is dyed before the pattern is printed on the cloth 41 in order to form the basic color of the pattern. A shrinkage ratio of about 2% is formed in the cloth 41 when the cloth 41 is dyed and dried. The cloth 41 is then printed with the pattern, and the cloth shrinks again after the pattern is dried. The cloth is then dipped in the water and taken out right away, this is a watering process, the cloth is then applied with acrylic waterproof glue and is dried at about 350° C. by a drier so as to further improve the water resistant capability of the cover 85. A shrinkage ratio of about 5% is further formed in the cloth 41 when the cloth 41 is dipped in the water and applied with the acrylic water-proof glue.

The shrinkage of the cloth prevents the cloth of plain weave organization from breakage when the cloth is stretched and hot-pressed which will be described in further details hereinafter.

After the cloth is dipped in the water and applied with the waterproof glue and after the pattern is printed thereon, the cloth is cut to a rectangular shape, two or more pieces of rectangular cloth are used and superposed. The perimeters of the pieces the cloth are fixed together by such as staples. It is preferable that five to eight pieces of rectangular cloth are used and superposed and fixed together.

Figure 3:
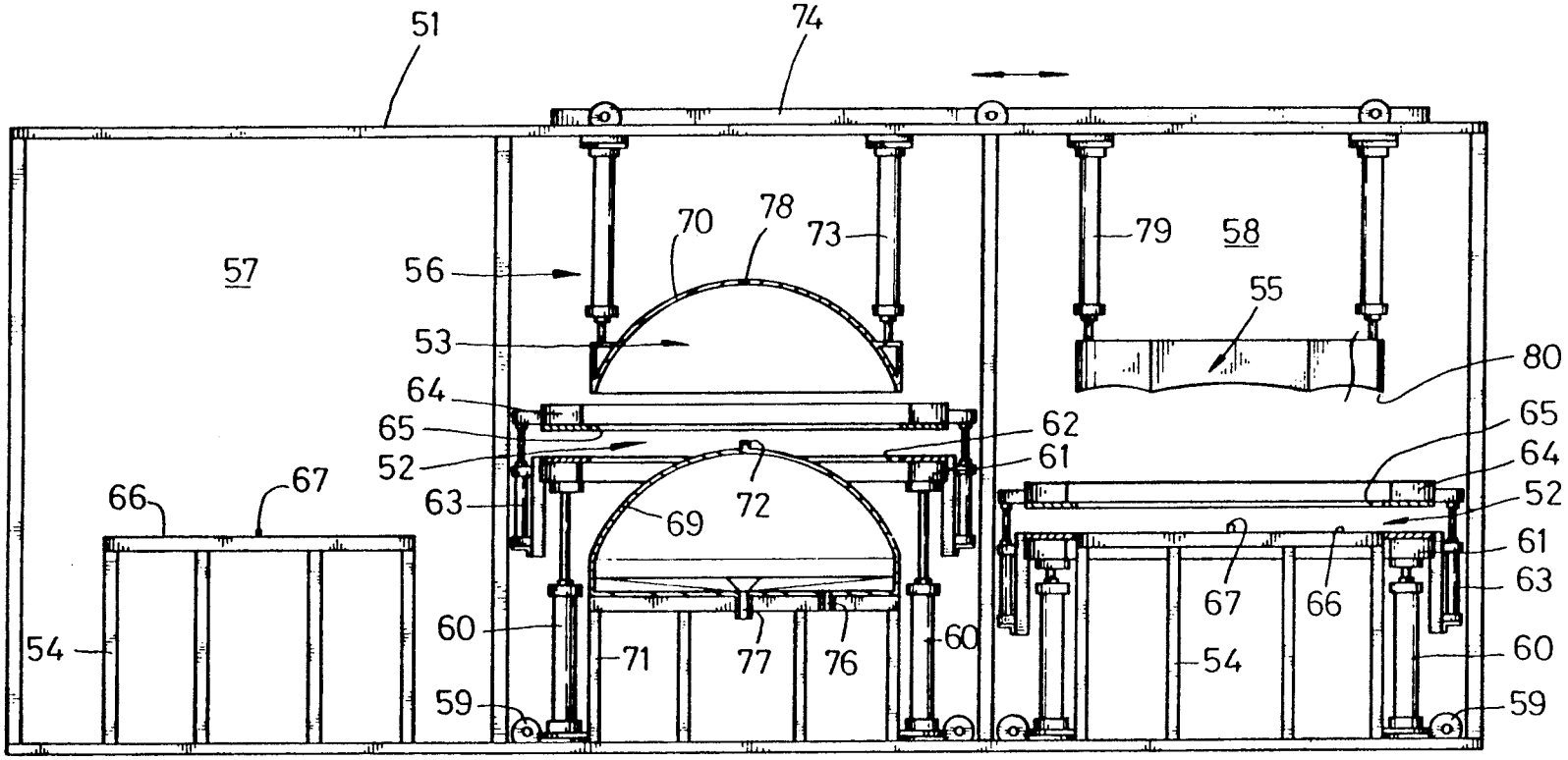
FIG. 3 is a plane view illustrating a mechanism for forming the cover of the umbrella.

Referring next to FIG. 3, illustrated is a mechanism for forming the cover of the umbrella. The mechanism generally includes a frame 51 substantially separated into three sections 56, 57, 58, two supports 54 disposed in two side sections 57, 58 respectively, two clamping devices 52 supported by four cylinders 60 which have a plurality of wheels 59 disposed in the lower portion such that the clamping devices 52 are movable between the sections 56, 57, 58 of the frame 51, a mold assembly 53 for hot-pressing the cloth 41 disposed in the middle section 56 and a cutting means 55 disposed in the side section 58. Each of the supports 54 includes a flat upper surface 66 and a stub 67 disposed in the middle portion of the upper surface 66 for engagement with the holes 42 of the cloth 41.

A base 71 is disposed in the lower portion of the middle section 56. The mold assembly 53 includes a lower mold 69 disposed on the base 71, the lower mold 69 is convex shape and includes a hollow interior having an inlet 76 and an outlet 77 formed in the lower portion thereof and includes a protrusion 72 formed on the upper portion for engagement with the holes 42 of the cloth 41. Steam and cold water can be supplied into the lower mold 69 via the inlet 76 and can flow out of the lower mold 69 via the outlet 77 in order to heat and to cold the lower mold 69. The interior of the lower mold 69 is applied with a layer of heat-resistant silicon covering. The mold assembly 53 further includes an upper mold 70 coupled to a carriage 74 by four cylinders 73 such that the lower mold 70 can be caused to move downward toward the lower mold 69. The carriage 74 is movable between the sections 56, 57, 58. The upper mold 70 has a concave shape for engagement with the convex shape of the lower mold 69 and includes a hole 78 formed in the center portion thereof.

Each of the clamping devices 52 includes a lower member 61 disposed on the cylinders 60 and arranged such that the lower member 61 can be caused to move up and down by the cylinders 60, and an upper member 64 disposed on four cylinders 63 which are fixed relative to the lower member 61 and arranged such that the upper member 64 can be caused to move toward and away from the lower member 61. The layers of cloth 41 are disposed between the lower and upper members 61, 64 and can be clamped by the members 61, 64 of the clamping devices 52 which is located within the section 57. At this moment, the perimeter of the cloth 41 can be fixed together by such as staples. Each of the members 61, 64 includes an opening 62, 65 formed therein. The clamping device 52 which carries the cloth 41 is then moved into the middle section 56 and the cloth 41 is arranged between the molds 69, 70.

Steam is supplied into the lower mold 69 via the inlet 76, at this moment, the outlet 77 is closed. The members 61, 64 are then moved downward by the cylinders 60 such that the cloth 41 will be stretched and pulled against the convex outer configuration of the lower mold 69. The temperature of the lower mold 69 is selected at a critical temperature such that the cloth 41 will be softened and such that the molecular grating or molecular structure will be loosened. For example, for Nylon 6, the softened temperature thereof is 171° C., and melt temperature thereof is 212° C.; for Nylon 66, the softened temperature thereof is 229° C., and melt temperature thereof is 250° C.; for Acrylic fibers, the softened temperature thereof is 204° C., and melt temperature thereof is 254° C.; for polyester materials, the softened temperature thereof is 238° C., and melt temperature thereof is 250° C. After the pieces of cloth are pulled and stretched, the organizations of the cloth will form a new organization such that the cloth will be formed with a bowl shape.

After the cloth is moved downward by the clamping device 52 and is contacted with the heated lower mold 69, the lower mold 69 is further heated so that the temperature of the lower mold 69 is higher than the softened temperature of the cloth or fibers. The organization of the cloth and fibers will be rearranged in order that a new organization is formed.

After the plain weave organization of the cloth 41 is changed and rearranged by an external force, the organization of the cloth 41 will be slightly recovered after the external force is released and before the cloth 41 is cooled. The upper mold 70 then moves downward to clamp the layers of cloth 41. The steam is further supplied into the lower mold 69 in order to increase the temperature higher than the softened temperature and close to the melt temperature of the cloth. The heat will be transferred to the cloth uniformly when the cloth is hot-pressed by the lower mold 69 and the upper mold 70, the molecular structure of the cloth and fibers will be loosened and reorganized such that the cloth will be formed with a fixed shape by the hot-pressing processes. The heat transfer directions of the cloth is uniform and no great errors will be formed.

Figure 4:
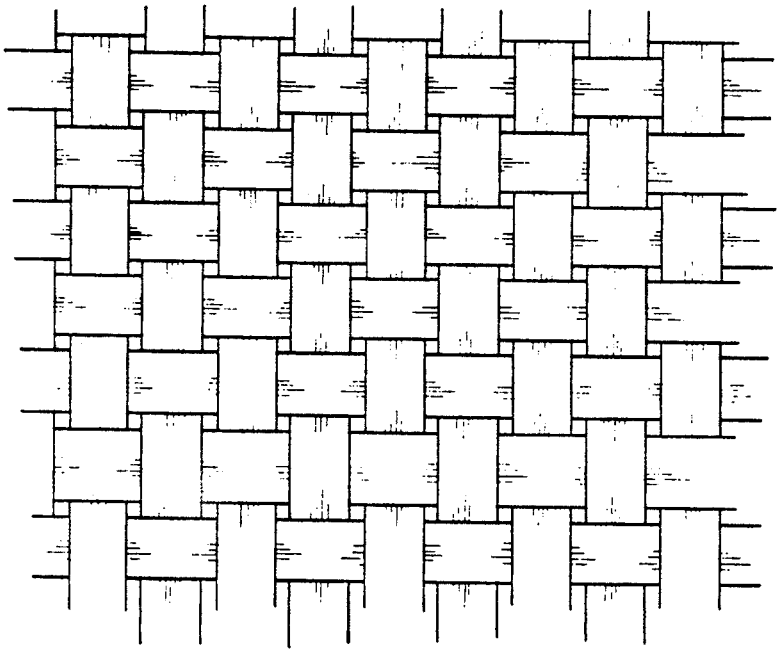
FIGS. 4 and 5 are schematic views illustrating the weaving of the cloth.
Figure 5:
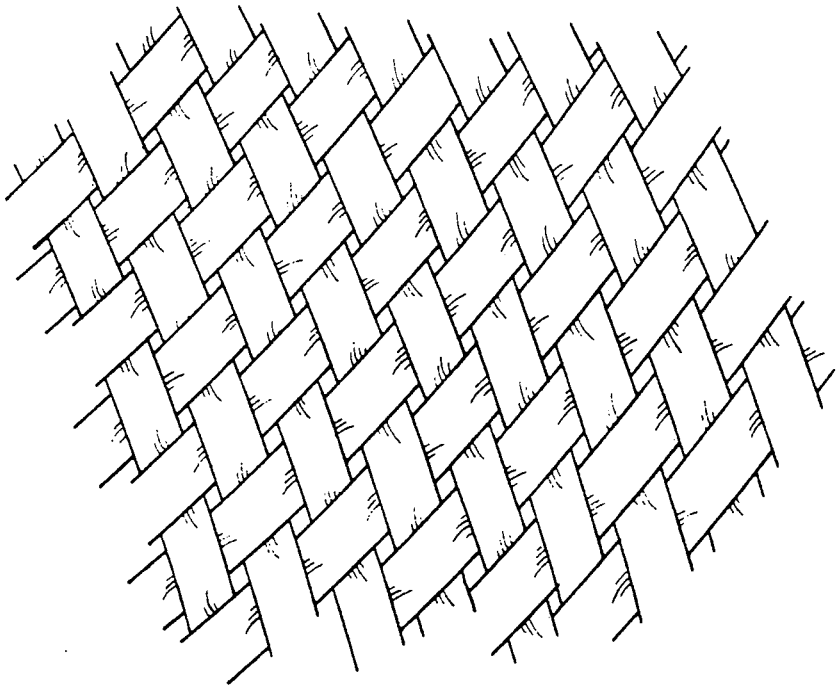

This higher temperature is last for about five minutes such that the shape of the cloth 41 is formed as the shape of the cover of the umbrella. The molecular structure of the fibers will be completely loosened alld a new equilibrium organization will be formed. Cold water is then charged into the lower mold 69 in order to lower the temperature thereof. The cloth is thus formed with a bowl shape which will not be deformed unless a higher temperature than the melt temperature of the cloth is applied to the cloth. The cloth is thus formed with the new equilibrium organization. The arrangement of the fibers of the cloth 41 will be changed from that is shown in FIG. 4 to that is shown in FIG. 5 after the cloth 41 is hot-pressed. The molecular structure of the new equilibrium organization includes equilibrium strength.

The shrinkage of the cloth during the dipping water processes provides the cloth with a stretchable capability. Gaps will be formed between the fibers of the plain weave configuration of the cloth when the cloth and fibers are stretched, and will be filled by the acrylic waterproof glue. The molecular structure of the acrylic waterproof glue will be reorganized, and the acrylic waterproof glue fills the gaps formed between the plain weave configuration of the fibers after the cloth is cooled, such that the cloth is water proof and water resistant.

Figure 6:
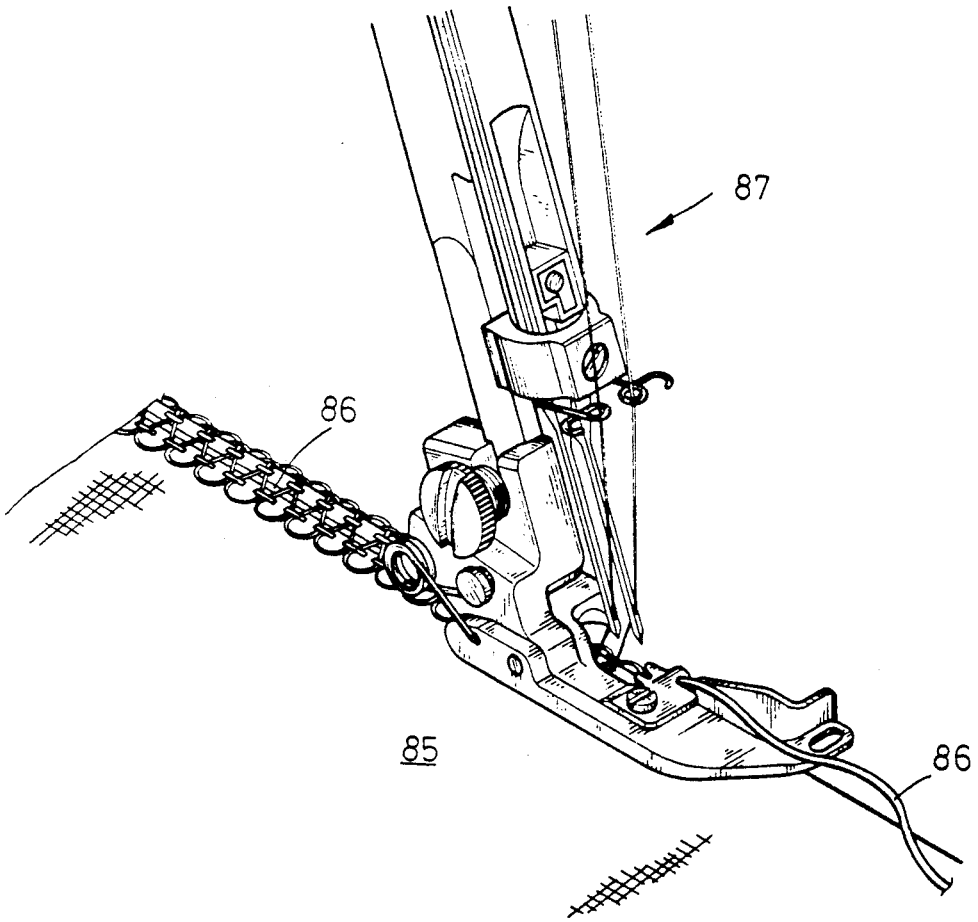
FIG. 6 is a schematic view illustrating the hemming operations of the cover.
Figure 7:
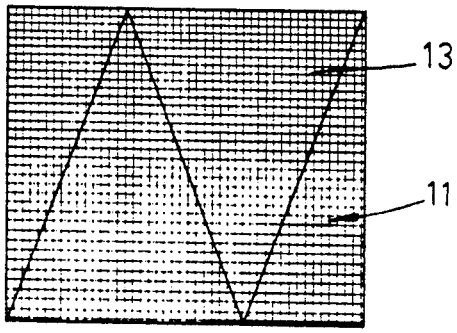
PRIOR ART FIG. 7
FIGS. 7 and 8 are plane views illustrating the cloth and the cut pieces for forming the conventional cover of the umbrella.
Figure 8:
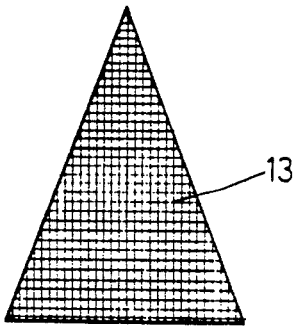
PRIOR ART FIG. 8
Figure 9:
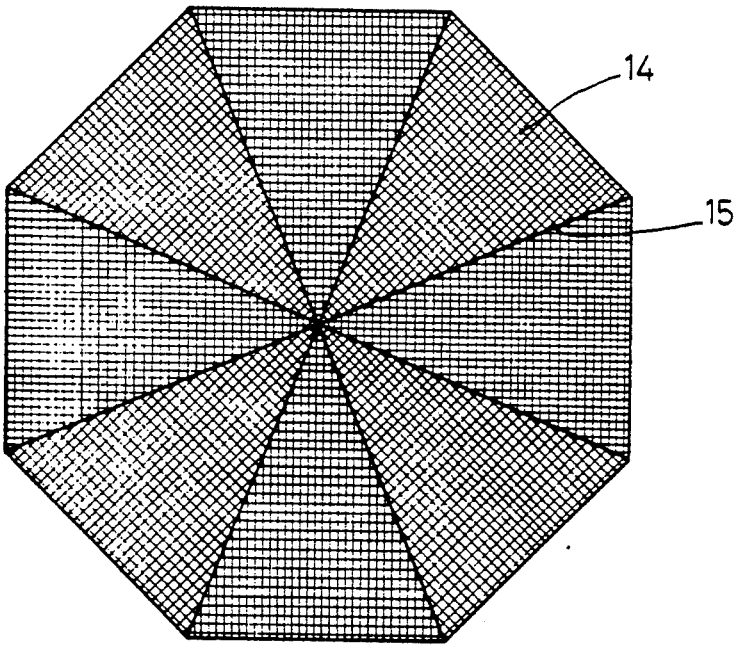
PRIOR ART FIG. 9
FIG. 9 is a plane view of a cover of the umbrella.

The cutting means 55 includes a cutting edge 80 formed in the bottom portion and is coupled to the frame 51 by four cylinders 79 such that the cutting means 55 can be caused to move downward to cut the cloth 41 disposed between the members 61, 64. After hot-press processes, the cloth 41 is moved to the section 58 and is cut by the cutting means 55 so as to form the cover of the umbrella. As shown in FIG. 6, the perimeter of the cover 85 is hemmed by a sewing machine 87, such as an overlock sewing machine, with a thread 86 disposed within the hem such that the cover 85 is formed. The beads 84 are then fixed to the corner areas of the cover 85. The cover 85 is then engaged onto the staves 83 so as to form an umbrella. The cover 85 includes a complete bowl shaped outer appearance and has no stitches formed therein, in addition, a complete printed pattern can be formed on the cover 85.

Accordingly, the method in accordance with the present invention can produce a cover of an umbrella in which the cloth for forming the cover need not be cut and stitched in order to form the cover. The pattern can be formed and printed on the cloth before the cloth is hot-pressed to form the cover. The cover can be made in a fast speed.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A method for forming a cover of an umbrella comprising:

preparing at least two pieces of cloth made of synthetic fibers and each having a plain weave configuration including two sets of fibers perpendicular with each other, each of said pieces of cloth including a perimeter;

watering said cloth;

applying waterproof glue on said cloth;

fixing said perimeters of said two layers of cloth together;

clamping said perimeters of said cloth by a clamping device, said clamping device including a lower member which is disposed on a first cylinder so that said lower member is movable up and down by said first cylinder, and an upper member disposed on a second cylinder which is disposed on said lower member so that said upper member is movable up and down by said second cylinder, said perimeters of said cloth being clamped by said upper member and said lower member when said upper member moves toward said lower member;

preparing a lower mold and an upper mold, said lower mold having a convex shaped outer surface and including a hollow interior having an outlet and an inlet formed therein, said upper mold having a concave shaped surface and movable downward toward said lower mold for engagement with said convex shaped outer surface of said lower mold;

moving said cloth to a position located above said lower mold;

pulling said cloth downward against said lower mold by said first cylinder when said lower member is caused to move toward said lower mold;

supplying heated steam into said lower mold so as to heat said lower mold to a temperature in order to soften said cloth;

moving said upper mold downward to clamp said cloth between said upper mold and said lower mold;

supplying heated steam into said lower mold in order to further heat said lower mold so as to further increase the temperature of said lower mold so that said cloth is hot-pressed, said plain weave configuration of said cloth including a molecular structure which is loosened and rearranged when said cloth is hot-pressed, and said cloth being stretched such that said fibers are not perpendicular with each other;

supplying cold water into said lower mold in order to cool said lower mold, said cloth being cooled such that said molecular structure of said plain weave configuration of said cloth having a fixed configuration and such that said cloth having an equilibrium strength;

removing said cloth and cutting said perimeter of said cloth so as to form said cover of said umbrella which is bowl shaped; and hemming a perimeter of said cover so that said cover is formed.

2. A method according to claim 1, wherein said cloth is dyed and printed with an integral pattern before said cloth is watered.

3. A method according to claim 1, wherein said cloth is made of nylon materials.

4. A method according to claim 1, wherein said cloth is made of polyester materials.

5. A method according to claim 1, wherein said cloth is made of acrylic materials.

6. A method according to claim 1, wherein said plain weave configuration is an equilibrium plain weave configuration.

7. A method according to claim 1, wherein said plain weave configuration is an unequilibrium plain weave configuration.

* * * * *